US005682778A

United States Patent [19]

Cohrs et al.

[11] Patent Number: 5,682,778

[45] Date of Patent: Nov. 4, 1997

[54] LEAD-IN DEVICE FOR AIDING THE INSTALLATION OF RIM-TYPE LOCK CYLINDERS

[75] Inventors: Richard B. Cohrs, Indianapolis, Ind.; James Mason, Birmingham, Mich.; Benjamin H. Akers, III, Indianapolis, Ind.

[73] Assignee: Von Duprin, Inc., Indianapolis, Ind.

[21] Appl. No.: 588,554

[22] Filed: Jan. 18, 1996

Related U.S. Application Data

[63] Continuation of Ser. No. 138,164, Oct. 15, 1993.

[51] Int. Cl.[6] ..... E05B 17/04

[52] U.S. Cl. ..... 70/370; 70/372; 70/379 R; 70/454; 70/466

[58] Field of Search ..... 70/379 R, 422, 70/466, 453, 454, 370, 372; 292/336.5

[56] References Cited

U.S. PATENT DOCUMENTS

| | | | |
|---|---|---|---|
| 1,060,413 | 4/1913 | Augenbraun | 70/471 X |
| 1,112,133 | 9/1914 | Hammond, Jr. | 70/454 |
| 1,115,744 | 11/1914 | Shaw | 70/370 |
| 1,190,439 | 7/1916 | Marchfeld | 70/379 R |
| 1,384,622 | 7/1921 | May | 70/454 |
| 1,437,878 | 12/1922 | Aldeen | 70/454 X |
| 1,503,281 | 7/1924 | Ottinger | 292/336.5 |
| 1,593,398 | 7/1926 | Eubanks | 70/454 |
| 1,820,504 | 8/1931 | Simon | 292/336.5 |
| 2,012,912 | 8/1935 | Hurd | 70/224 |
| 2,042,021 | 5/1936 | Schlage | 70/134 |
| 2,303,790 | 12/1942 | Chesler | 70/451 |
| 2,449,711 | 9/1948 | Milligan | 70/478 X |
| 2,484,961 | 10/1949 | Russell et al. | 70/379 R |
| 2,566,490 | 9/1951 | Heinz | 70/454 |
| 3,760,619 | 9/1973 | Colombo | 70/DIG. 60 X |
| 4,063,765 | 12/1977 | Waldo | 292/335 |
| 4,550,580 | 11/1985 | Neyret | 70/379 R X |
| 4,821,542 | 4/1989 | Rosenthal | 70/454 |
| 4,987,758 | 1/1991 | Eisermann | 70/379 R |

FOREIGN PATENT DOCUMENTS

| | | | |
|---|---|---|---|
| 180006 | 3/1954 | Austria | 70/454 |
| 529776 | 2/1930 | Germany | 70/454 |
| 3036296 | 5/1982 | Germany . | |
| 57535 | 5/1946 | Netherlands | 70/454 |

*Primary Examiner*—Lloyd A. Gall

*Attorney, Agent, or Firm*—Robert F. Palermo; Michael H. Minns

[57] ABSTRACT

A lead-in device is used during installation of a rim-type lock cylinder having a tailpiece in an exit mechanism including a cam having a tailpiece receiving aperture. The lead-in device includes a converging tunnel having an exit aperture sized to match the tailpiece receiving aperture and an entrance aperture that is larger than the exit aperture. The lead-in device also includes a pair of arms positioned to be inserted into the cam aperture to hold the exit aperture in registry with the cam aperture and to maintain the entrance aperture at a predetermined distance from the cam. When the arms are positioned in the cam aperture and the exit aperture is in registry with the cam aperture, the converging tunnel guides a tailpiece inserted into the entrance aperture through the exit aperture and into the cam aperture to engage the cam.

5 Claims, 3 Drawing Sheets

LEAD-IN DEVICE FOR AIDING THE INSTALLATION OF RIM-TYPE LOCK CYLINDERS

This application is a continuation of application Ser. No. 08/138,164 filed Oct. 15, 1993, now abandoned.

BACKGROUND OF THE INVENTION

The present invention relates to devices used in the installation of lock cylinders, and more particularly, to devices used in the installation of lock cylinders having a tailpiece for engaging a cam in an exit mechanism.

Many buildings have doors that are equipped with panic exit mechanisms which generally include a pair of casings, mounted near the opposite edges of a door, a panic bar, on the interior surface of the door, spanning the door and coupled to the casings, and a retractable latch bolt with a retraction mechanism coupled to, and actuated by, the panic bar. Pushing on the panic bar retracts the latch bolt into the casing and releases the door for opening. The doors can also be opened from the outside by a conventional doorknob or handle.

In some situations, it is necessary to provide a panic exit mechanism, yet it is undesirable to allow easy access from the outside. To improve the security of panic exit systems, locks have been installed on the outside of the door to actuate locking and unlocking functions. The lock allows access from the outside, but only to those who have the appropriate key. Typically, the outside lock is a rim-type lock cylinder having a tailpiece, which is a long rectangular part extending from the rear of the cylinder. The lock cylinder is mounted to a trim piece on the door and the tailpiece extends through the door to engage and rotate a cam located in the casing on the inside of the door. The cam generally includes a cruciform mating aperture sized for receiving the tailpiece. Rotation of the cam operates the locking and unlocking functions of the exit mechanism.

The tailpiece is attached to the back of the lock cylinder but is free to move from side-to-side and up-and-down. This freedom of movement is required to compensate for any slight misalignment between the lock cylinder and the cam during the installation process. During installation of an exit mechanism, the casing is mounted on the inside of the door and a trim plate, with a lock cylinder attached, is mounted on the outside of the door. The tailpiece extends through the door and into the mating aperture of the cam, thereby rotationally coupling the lock cylinder to the cam. Were the tailpiece rigidly attached to the lock cylinder, the cam and the lock cylinder would have to be precisely aligned. A slight misalignment would prevent the tailpiece from entering the mating aperture and thereby prevent installation. The freedom of movement of the tailpiece compensates for slight misalignment between the lock cylinder and the cam, and thereby facilitates installation of the exit mechanism.

Unfortunately, the freedom of movement that permits easy alignment of the lock cylinder and cam during installation also increases the difficulty of inserting the tailpiece into the mating aperture in the cam. Due to space limitations imposed by the depth of the casing, the tailpiece is cut to a length that is just sufficient to reach through the door and engage the cam. As a result, the lock cylinder and trim plate must be at or very near the door in order for the tailpiece to reach the mating aperture. Consequently, the trim plate and lock cylinder block the installer's view of the mating aperture, greatly increasing the difficulty of inserting the tailpiece into the mating aperture and increasing the time consumed in the installation process. In fact, the difficulty of inserting the tailpiece into the mating aperture is the biggest complaint from installers. Thus, any device which facilitates the insertion of the tailpiece into the mating aperture would be welcomed by installers.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a lead-in device for installing a lock cylinder in an exit mechanism, including a tailpiece and a cam having a mating aperture for receiving the tailpiece therein, the lead-in device having provisions for guiding the tailpiece into the mating aperture and for coupling the guiding means to the cam.

The foregoing and other aspects will become apparent from the following detailed description of the invention when considered in conjunction with the accompanying drawings.

DETAILED DESCRIPTION

Figure 1:
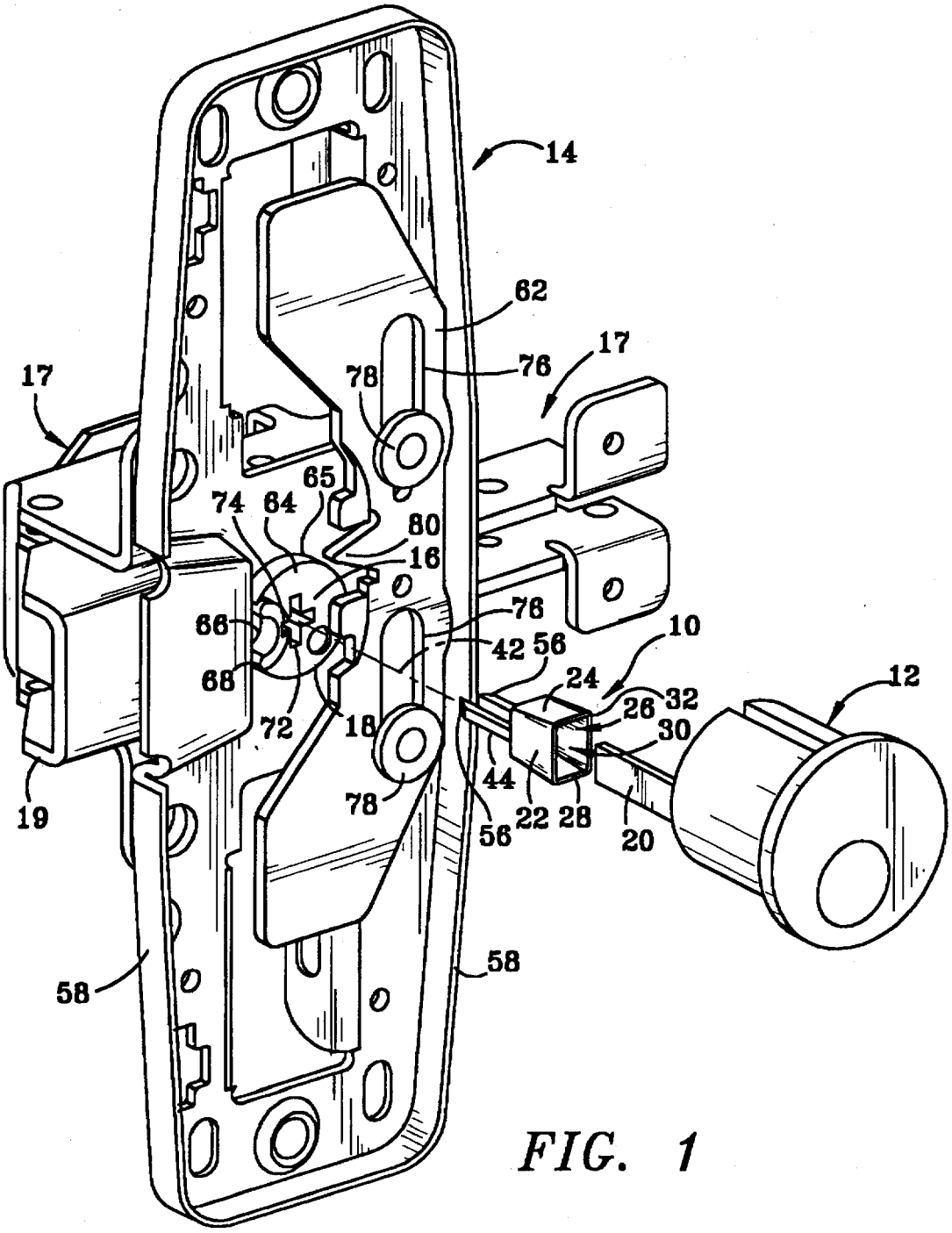
FIG. 1 is a perspective view of the lead-in device of the present invention shown in relation to a cam of an exit mechanism and the tailpiece of a lock cylinder.
Figure 2:
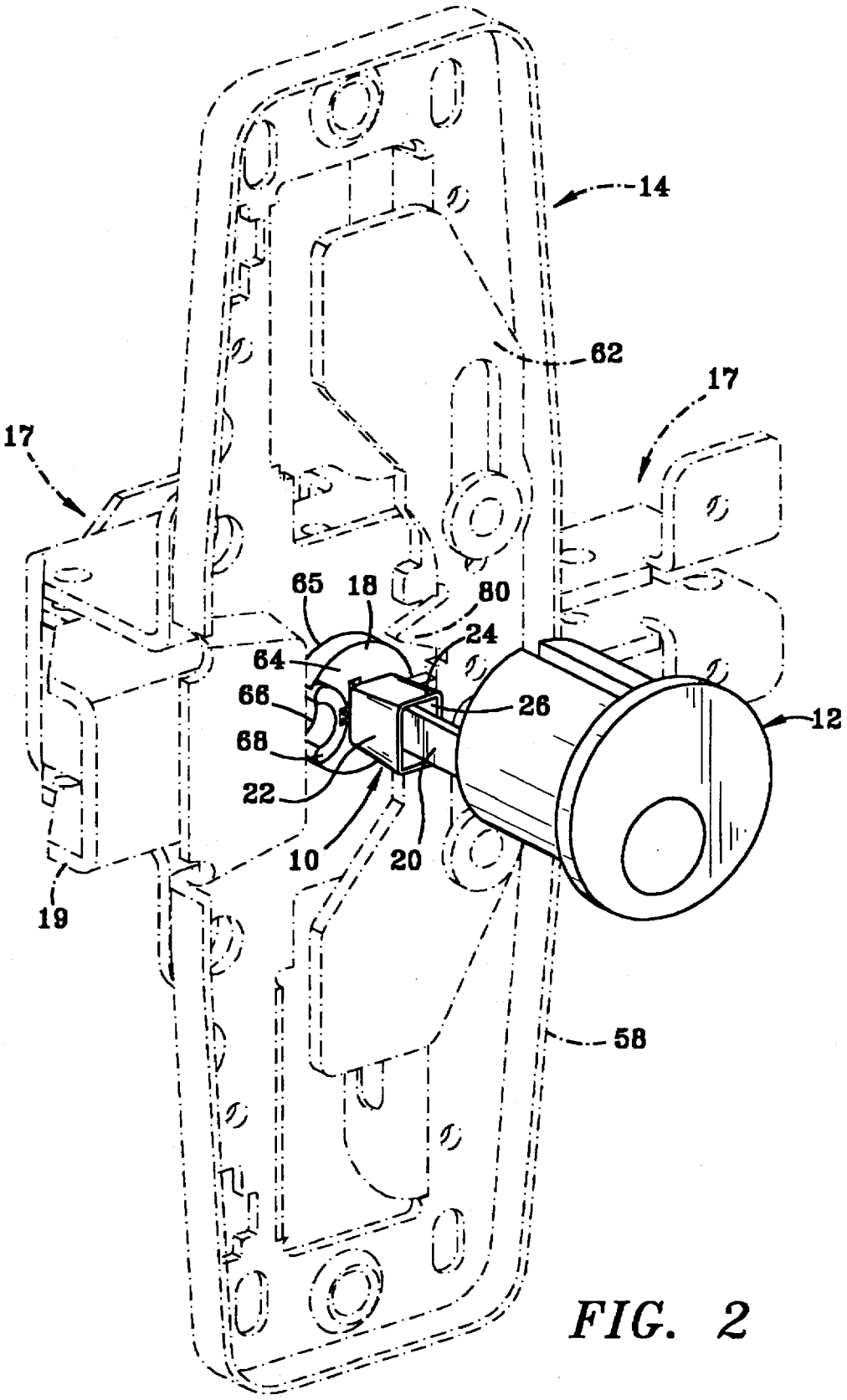
FIG. 2 is a view similar to FIG. 1 with the lead-in device inserted in the mating aperture and the tailpiece positioned in the entrance aperture of the lead-in device.

A lead-in device 10 for use in installing a lock cylinder 12 in an exit mechanism 14 is shown in FIGS. 1–5. In use, the lead-in device 10 is aligned, as shown in FIG. 1, with a cruciform mating aperture 16 formed in an element such as cam 18, which is part of the exit mechanism 14. A tailpiece 20, attached to the lock cylinder 12, is aligned with the lead-in device 10 and mating aperture 16. The lead-in device 10 is inserted into the mating aperture 16, as shown in FIG. 2, and the tailpiece 20 is inserted into the lead-in device 10 to be guided into the mating aperture 16 to engage the cam 18. By entering the mating aperture 16 and engaging the cam 18, the tailpiece 20 couples the lock cylinder to the exit mechanism and allows an operator to operate the locking and unlocking functions of the exit mechanism 14 by turning a key (not shown) in the lock cylinder 12. The lead-in device 10 increases the effective cross sectional area of the mating aperture 16 to facilitate insertion of the tailpiece 20 into the mating aperture 16 during installation of the exit mechanism 14. At the same time, the lead-in device 10, in effect, moves the opening of the mating aperture away from the cam and toward the installer, further facilitating installation by improving the installer's ability to see the aperture.

During installation, the exit mechanism 14 is mounted on the inside of a door (not shown). The exit mechanism 14 typically includes a casing 58, a panic bar (not shown)

spanning the door, and a retraction mechanism shown generally as 17 for retracting a latch bolt 19 to release the door. A trim piece (not shown) is typically attached to the outside of the door. The lock cylinder 12 is coupled to the trim piece so that the tailpiece 20 extends through the door to engage the cam 18. The door and the outside trim piece have been eliminated from FIGS. 1–3 to more clearly show the relationship between the tailpiece 20, the lead-in device 10 and the cam 18.

The lead-in device 10 can be employed with a wide variety of exit mechanisms and the illustrated mechanism is merely exemplary. A suitable casing 58 and latch-operating mechanism 17 for a panic exit mechanism 14 is described, for example, in U.S. Pat. No. 4,978,151 issued to Coleman, et al. on Dec. 18, 1990, the disclosure of which is incorporated herein by reference.

Generally, an exit mechanism 14 of this class includes a cam 18 which is positioned inside the casing 58 for engaging a sliding throw member 62, also positioned in the casing 58. The cam 18 is a generally circular disk having a proximal surface 64 and a distal surface 65, and includes a semi-circular notch 66 cut into the perimeter of the disk. A semi-circular collar 68 extends orthogonally from the proximal surface 64 at the semi-circular notch 66.

Figure 6:
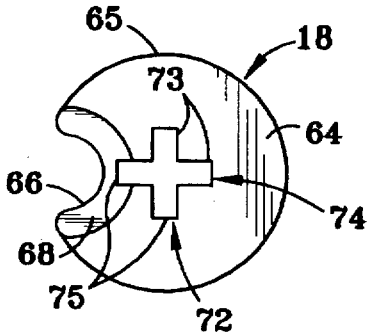
FIG. 6 is an end view of the cam showing the cruciform mating aperture.

The cam 18 also includes a central cruciform mating aperture 16 as depicted in FIG. 6. The mating aperture 16 includes two orthogonal rectangular slots 72, 74 that are substantially similar in size and shape and bisect each other at the center of the cam 18. Each slot 72, 74 is dimensioned to receive the tailpiece 20 of the lock cylinder 12, and includes first and second ends 73, 75.

The exit mechanism 14 includes a sliding throw member 62 positioned in the casing 58 for actuating the locking and unlocking functions of the mechanism 14. The throw member 62 is a flat plate having a pair of elongated apertures 76 for receiving retaining posts 78. The retaining posts 78 extend through the casing 58 and the elongated apertures 76. Swaged ends, washers, or other suitable retaining means 78 keep the throw member 62 from falling off the retaining posts 78. The sliding throw member 62 is free to slide inside the casing 58, constrained only by the retaining posts 78 in the elongated apertures 76.

The throw member 62 generally also includes a triangular engagement tab 80. The semi-circular notch and collar 66, 68 of the cam 18 are positioned to engage the engagement tab 80. As the cam 18 rotates, the notch and collar 66, 68 move the engagement tab 80 in a direction tangential to the cam 18, sliding the throw member 62 along the retaining posts 78 and actuating the locking and unlocking functions of the exit mechanism 10. Actuation of the locking and unlocking functions by the throw member 62 is well known to those skilled in the art and will not be discussed further.

The lock cylinder 12 used in conjunction with the present invention is a rim-type lock cylinder having a tailpiece 20, and is well known to those skilled in the art. The tailpiece 20 is a rectangular piece of metal that is coupled to the lock cylinder 12 by a pair of screws (not shown), or the like, that allows the tailpiece 20 to move in a side-to-side and an up-and-down direction, but limits rotational movement relative to the lock cylinder 12.

During installation of an exit mechanism, the casing 58 is mounted on the inside of the door and a trim plate (not shown), with a lock cylinder 12 attached, is mounted on the outside of the door. The tailpiece 20 extends through the door and into one of the rectangular slots 72, 74 in the mating aperture 16 of the cam 18, thereby rotationally coupling the lock cylinder 12 to the cam 18. Were the tailpiece 20 rigidly attached to the lock cylinder 12, the cam 18 and the lock cylinder 12 would have to be precisely aligned. A slight misalignment would prevent the tailpiece 20 from entering the rectangular slot 72, 74 in the cam 18 and prevent installation. The freedom of movement of the tailpiece 20 compensates for slight misalignment between the lock cylinder 12 and the cam 18, and thereby facilitates installation of the exit mechanism 14.

Unfortunately, during installation of the exit mechanism 10, the freedom of movement of the tailpiece 20 increases the difficulty of inserting the tailpiece 20 into the rectangular slot 72, 74. Due to space limitations imposed by the depth of the casing 58, the tailpiece 20 is cut to a length that is just sufficient to reach through the door and engage the cam 18. As a result, the lock cylinder and trim plate must be at or very near the door for the tailpiece 20 to reach the cam, and thereby block the installer's view of the rectangular slots 72, 74, forcing the installer into a "fishing expedition" to find the slot 72, 74 with the end of the tailpiece 20. Installers have had great difficulty with the insertion of the tailpiece 20 into the rectangular slots, and that difficulty has been their biggest complaint.

Advantageously, the lead-in device 10 of the present invention facilitates the insertion of the tailpiece 20 into the rectangular slots 72, 74 by increasing the effective cross sectional area of the slot 72, 74. The lead-in device 10 includes four walls 22, 24, 26 and 28 which cooperate to define a rectangular tunnel 30 having a rectangular entrance aperture 32 and a rectangular exit aperture 36. The walls 22, 24, 26 and 28 converge from the entrance aperture 32 to the exit aperture 36, so that the cross sectional area of the tunnel 30 is greater at the entrance aperture 32 than at the exit aperture 36, as best seen in FIGS. 4–5.

Walls 22 and 26 define a width dimension for the entrance and exit apertures and walls 24 and 28 define a height dimension for the apertures. The rectangular exit aperture 36 has a height dimension 35 and a width dimension 37, wherein the height dimension 35 is greater than the width dimension 37. The rectangular entrance aperture 32 has larger, but proportionally similar, width and height dimensions, resulting in an entrance aperture 32 that is larger than the exit aperture 36. In preferred embodiments, the entrance aperture 32 is at least three times larger than the exit aperture 36.

A shoulder 40 is formed on each of walls 22 and 26 adjacent the exit aperture 36. The shoulders 40 extend orthogonally outwardly from the exit aperture 36 away from the longitudinal axis 42 (FIG. 1) of the lead-in device 10. Walls 24, 28 include thickened reinforcing portions 34 that extend from the entrance aperture 32 for approximately half the length of walls 24 and 28 between the entrance and exit apertures 32 and 36.

Figure 4:
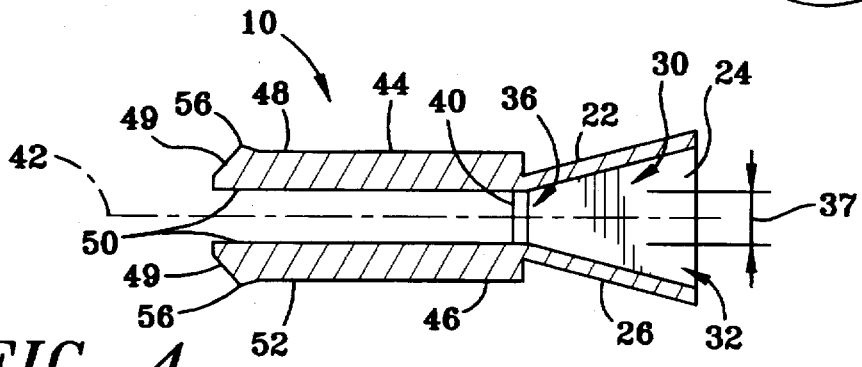
FIG. 4 is a longitudinal sectional view taken through the lead-in device showing the converging tunnel, the arms extending from shoulders formed at the exit, and the engaging fingers formed on the distal ends of the arms.
Figure 5:
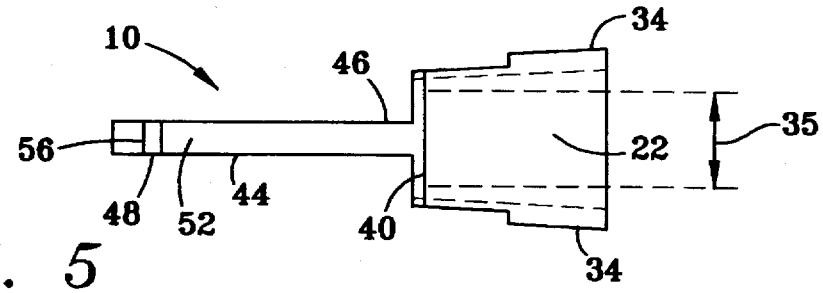
FIG. 5 is a side view of the lead-in device.

Resilient arms 44 extend from the shoulders 40 in parallel spaced-apart relation to the longitudinal axis 42 and are separated by a distance equal to the width dimension 37 of the exit aperture 36, as shown in FIG. 4. Each arm 44 includes a proximal end 46 attached to a shoulder 40, a distal end 48, an inner surface 50, and an outer surface 52. Each distal end 48 includes a beveled edge 49 which extends from the inner surface 50 beyond the outer surface 52 to form an engaging finger 56 that projects outwardly from the outer surface 52.

The arms 44 lie in a plane that bisects the height 35 of the exit aperture 36, with the arms 44 positioned respectively on opposite sides of the exit aperture 36. The plane of the arms 44 and the exit aperture 36 are oriented relative to each other so that when the plane of the arms 44 is aligned with the first (or second) slot 72, 74, the exit aperture 36 is aligned with the second (or first) slot 74, 72. The fingers 56 are positioned on the arms 44 to engage the distal surface 65 of the cam 18 to hold the exit aperture 36 adjacent the cam 18.

Figure 3:
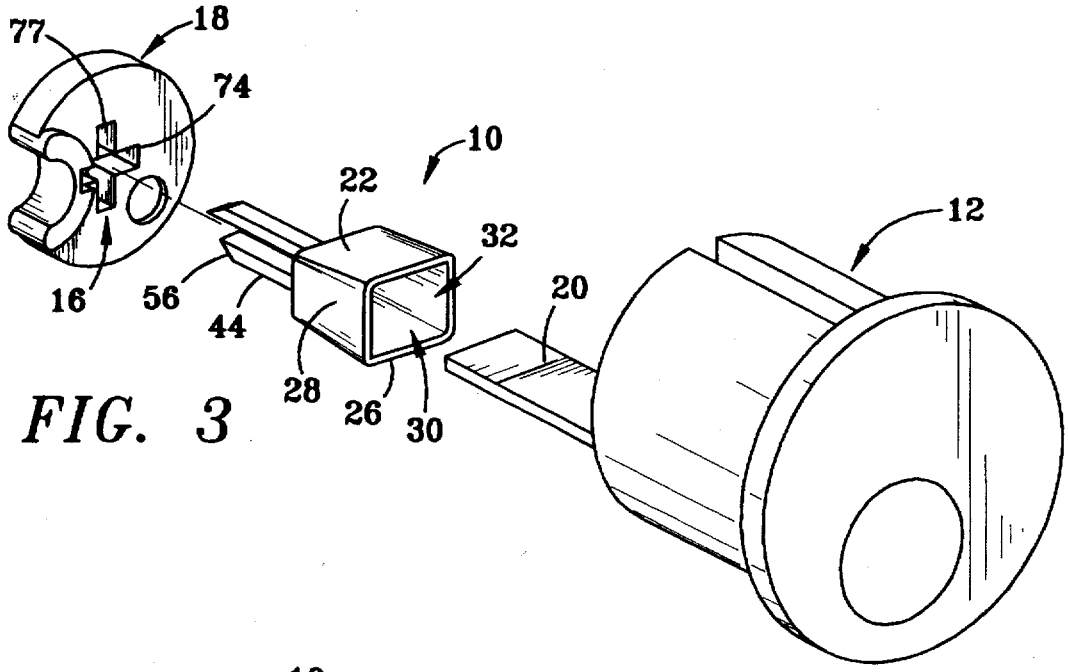
FIG. 3 is a perspective view of the lead-in device positioned between the cruciform mating aperture and the tailpiece of the lock cylinder in a fashion similar to FIG. 1, but this time with a horizontally oriented tailpiece.

As shown in FIGS. 1 and 3, the lead-in device 10 is aligned with the mating aperture 16 in the cam 18. Since the arms 44 lie in a plane that bisects the height 35 of the exit aperture 36, the arms 44 are positioned to enter one of the slots 72, 74 when the exit aperture 36 is oriented in registry with the other slot 74, 72. The arms 44 are inserted into the slots 72, 74 until the shoulders 40 abut the proximal surface 64 of the cam 18. As the arms 44 are inserted, the beveled edges 49 cam against the ends 73, 75 of the slots 72, 74, deflecting the arms 44 toward each other and allowing the engaging fingers 56 to pass through the slots 72, 74. When the engaging fingers 56 have passed through the slots 72, 74, the arms 44 return to their original position relative to each other, positioning the outer surfaces 52 against the ends 73, 75 and moving the engagement fingers 56 into abutment with the distal surface 65 of the cam 18. The engagement fingers 56 are positioned on the arms 44 so as to position the shoulders 40 in abutment with the mating aperture 16 when the engagement fingers 56 engage the distal surface 65.

Advantageously, the engagement fingers 56 and the shoulders 40 cooperate to hold the lead-in device 10 in position in the mating aperture 16, thus freeing both hands to manipulate the trim piece, lock cylinder 12 and tailpiece 20 into position. By maintaining the length of the lead-in device 10 so as to fit inside the door, the lead-in device 10 can remain in the mating aperture without effecting the operation of the lock cylinder 12. At the same time, the length of the lead-in device 10, in effect, extends the opening in the mating aperture 16 away from the cam 18 and toward the installer to improve the installer's ability to see the opening, thereby further facilitating the installation of the lock cylinder.

Since the lead-in device 10 performs no operating function after the lock cylinder 12 is fully installed, the material forming the lead-in device 10 need not have any special strength or wear-resistance characteristics. The lead-in device 10 must be made of a material which will permit the necessary deformation of the arms 44 to permit the fingers 56 to engage the distal surface 65 of the cam 18. A suitable material for the lead-in device 10 is 30% glass filled nylon 6/6 or other similar polymer. The lead-in device 10 can be made by any number of processes including injection molding.

What is claimed is:

1. An insertable lead-in device in combination with a lock cylinder having a movable tailpiece, and an exit mechanism including a cam having a mating aperture for mating with and receiving the tailpiece therein, the insertable lead-in device comprising:

a plurality of walls arranged to define a converging conduit having an entrance and an exit, said entrance being larger than said exit and generally perpendicular to a longitudinal axis of said lead-in device; and a pair of arms extending from a surface surrounding the exit, insertable into the mating aperture, each arm including a finger disposed to position the exit of the conduit adjacent the aperture, wherein the plurality of walls includes a first wall and a second wall, the first and second walls forming opposite sides of the conduit, the exit including a shoulder extending from each of the first and second walls and away from the longitudinal axis, the arms extending from the shoulders in parallel spaced-apart relation to each other and parallel to the longitudinal axis, the plurality of walls further including a third wall and a fourth wall situated with respect to the first and second walls to form a rectangular entrance and exit apertures, the walls being inclined with respect to each other such that the entrance aperture is larger than the exit aperture.

2. The combination of claim 1, wherein the arms lie in a first plane which includes the longitudinal axis, the first plane bisecting the exit aperture, the exit aperture being positioned between the arms.

3. An insertable lead-in device for use with a lock cylinder to be installed into an exit mechanism, the lock cylinder of the type having a movable tailpiece, and the exit mechanism of the type including a rotatable cam having a cam aperture with an effective capture area for receiving the tailpiece therein, wherein the insertable lead-in device comprises:

means for increasing the capture area of the cam aperture to facilitate insertion of the tailpiece into the cam aperture to couple the lock cylinder to the exit mechanism, and coupling means for coupling the means for increasing the capture area to the cam so that said means for increasing the capture area is rotatably driven by said cam, said coupling means including first and second flexible arms, each arm attached at its proximal end to said means for increasing the capture area and insertable into the cam aperture so as to position the means for increasing the capture area adjacent the cam aperture, and each arm having attached thereto at its distal end a means for retaining the means for coupling in position, wherein the means for increasing the capture area includes a plurality of walls arranged to define a converging rectangular conduit having an entrance aperture at one axial end and an exit aperture, smaller than the entrance aperture, at an opposite axial end, the exit aperture being substantially similar in shape to a portion of a cam aperture into which a tailpiece is received.

4. An insertable lead-in device in combination with a lock cylinder having a movable tailpiece, and an exit mechanism including a cam having a mating aperture for mating with and receiving the tailpiece therein, the insertable lead-in device comprising:

a plurality of walls arranged to define a converging conduit having an entrance and an exit, said entrance being larger than said exit and generally perpendicular to a longitudinal axis of said lead-in device; and a pair of arms extending from a surface surrounding the exit, insertable into the mating aperture, each arm including a finger disposed to position the exit of the conduit adjacent the aperture, wherein: said mating aperture comprises two orthogonal rectangular slots which bisect each other, a first of said slots receiving said tailpiece and a second of said slots receiving said arms.

5. An insertable lead-in device in combination with a lock cylinder and exit mechanism, as claimed in claim 4, wherein:

said exit is rectangular in shape;

said arms being disposed relative to said exit so that said exit is aligned with said first slot in a direction perpendicular to said longitudinal axis when said arms are inserted into said second slot.

* * * * *